US009773403B2

(12) United States Patent
Morgan et al.

(10) Patent No.: US 9,773,403 B2
(45) Date of Patent: Sep. 26, 2017

(54) HYGIENE COMPLIANCE SYSTEM

(71) Applicant: Hill-Rom Services, Inc., Batesville, IN (US)

(72) Inventors: Matthew D. Morgan, Cary, NC (US); Joshua P. Lingenfelser, Fuquay Varina, NC (US); Bradley T. Smith, Raleigh, NC (US); Christian Saucier, Raleigh, NC (US); Andrew S. Robinson, Durham, NC (US); Timothy D. Wildman, Metamora, IN (US); Kelly F. Walton, Cary, NC (US); Hailey R. Hamalainen, Raleigh, NC (US); Christopher Perry, Chapel Hill, NC (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 15/206,604

(22) Filed: Jul. 11, 2016

(65) Prior Publication Data

US 2017/0032656 A1 Feb. 2, 2017

Related U.S. Application Data

(60) Provisional application No. 62/197,898, filed on Jul. 28, 2015.

(51) Int. Cl.
*G08B 23/00* (2006.01)
*G08B 21/24* (2006.01)

(52) U.S. Cl.
CPC ..... *G08B 21/245* (2013.01)

(58) Field of Classification Search
CPC ..... G08B 21/18; G08B 21/24; G08B 21/182; G08B 13/2434; G08B 21/245; G08B 21/02; G08B 13/2417
USPC ..... 340/572.1–573.1
See application file for complete search history.

(56) References Cited

U.S. PATENT DOCUMENTS

| | | | |
|---|---|---|---|
| 4,275,385 | A | 6/1981 | White |
| 4,601,064 | A | 7/1986 | Shipley |
| 4,896,144 | A | 1/1990 | Bogstad |
| 5,016,172 | A | 5/1991 | Dessertine |
| 5,095,925 | A | 3/1992 | Elledge et al. |

(Continued)

FOREIGN PATENT DOCUMENTS

| | | |
|---|---|---|
| DE | 19903079 | 8/2000 |
| EP | 2 985 739 A1 | 2/2016 |

(Continued)

OTHER PUBLICATIONS

European Search Report from related EP 16 18 1426 dated Jan. 9, 2017, 16 pages.

(Continued)

*Primary Examiner* — Kerri McNally
*Assistant Examiner* — Sharmin Akhter
(74) *Attorney, Agent, or Firm* — Barnes & Thornburg LLP

(57) ABSTRACT

According to the present disclosure, a hygiene compliance system includes a handwash sensor, a badge, an occupant sensor, and a remote computer. The sensors and the badge may communicate with the remote computer to provide information regarding hygiene events. The hygiene compliance system determines whether the hygiene events comply with a hygiene operations scheme.

16 Claims, 6 Drawing Sheets

(56) References Cited

U.S. PATENT DOCUMENTS

| | | | |
|---|---|---|---|
| 5,119,104 | A | 6/1992 | Heller |
| 5,199,118 | A | 4/1993 | Cole et al. |
| 5,202,666 | A | 4/1993 | Knippscheer |
| 5,265,628 | A | 11/1993 | Sage et al. |
| 5,276,496 | A | 1/1994 | Heller et al. |
| 5,291,399 | A | 3/1994 | Chaco |
| 5,355,222 | A | 10/1994 | Heller et al. |
| 5,387,993 | A | 2/1995 | Heller et al. |
| 5,426,425 | A | 6/1995 | Conrad et al. |
| RE35,035 | E | 9/1995 | Shipley |
| 5,455,851 | A | 10/1995 | Chao et al. |
| 5,465,082 | A | 11/1995 | Chao |
| 5,515,426 | A | 5/1996 | Yacenda et al. |
| 5,548,637 | A | 8/1996 | Heller et al. |
| 5,561,412 | A | 10/1996 | Novak et al. |
| 5,572,195 | A | 11/1996 | Heller et al. |
| 5,573,041 | A | 11/1996 | Skell et al. |
| 5,594,786 | A | 1/1997 | Chao et al. |
| 5,610,589 | A | 3/1997 | Evans et al. |
| 5,633,742 | A | 5/1997 | Shipley |
| 5,670,945 | A | 9/1997 | Applonie |
| 5,689,229 | A | 11/1997 | Chaco et al. |
| 5,694,323 | A | 12/1997 | Koropitzer et al. |
| 5,695,091 | A | 12/1997 | Winnings et al. |
| 5,699,038 | A | 12/1997 | Urlich et al. |
| 5,702,115 | A | 12/1997 | Pool |
| 5,745,272 | A | 4/1998 | Shipley |
| 5,771,925 | A | 6/1998 | Lewandowski |
| 5,774,865 | A | 6/1998 | Glynn |
| 5,781,942 | A | 7/1998 | Allen et al. |
| 5,785,181 | A | 7/1998 | Quartararo, Jr. |
| 5,793,653 | A | 8/1998 | Segal |
| 5,808,553 | A | 9/1998 | Cunningham |
| 5,812,059 | A | 9/1998 | Shaw et al. |
| 5,818,617 | A | 10/1998 | Shipley |
| 5,822,418 | A | 10/1998 | Yacenda et al. |
| 5,822,544 | A | 10/1998 | Chao et al. |
| 5,823,447 | A | 10/1998 | Maybach |
| 5,838,223 | A | 11/1998 | Gallant et al. |
| 5,862,546 | A | 1/1999 | Kim |
| 5,870,105 | A | 2/1999 | Jensen |
| 5,900,067 | A | 5/1999 | Jones |
| 5,900,801 | A | 5/1999 | Heagle et al. |
| 5,939,974 | A | 8/1999 | Heagle et al. |
| 5,945,910 | A | 8/1999 | Gorra |
| 5,952,924 | A | 9/1999 | Evans et al. |
| 5,954,069 | A | 9/1999 | Foster |
| 5,960,991 | A | 10/1999 | Ophardt |
| 5,966,753 | A | 10/1999 | Gauthier et al. |
| 6,000,429 | A | 12/1999 | Van Marcke |
| RE36,530 | E | 1/2000 | Heller et al. |
| 6,031,461 | A | 2/2000 | Lynn |
| 6,038,331 | A | 3/2000 | Johnson |
| 6,104,295 | A | 8/2000 | Gaisser et al. |
| 6,125,482 | A | 10/2000 | Foster |
| 6,147,607 | A | 11/2000 | Lynn |
| 6,154,139 | A | 11/2000 | Heller |
| 6,195,588 | B1 | 2/2001 | Gauthier et al. |
| 6,211,788 | B1 | 4/2001 | Lynn et al. |
| 6,219,164 | B1 | 4/2001 | Morgaine |
| 6,236,317 | B1 | 5/2001 | Cohen et al. |
| 6,236,953 | B1 | 5/2001 | Segal |
| 6,278,372 | B1 | 8/2001 | Velasco, Jr. et al. |
| 6,283,759 | B1 | 9/2001 | Price et al. |
| 6,377,868 | B1 | 4/2002 | Gardner, Jr. |
| 6,392,546 | B1 | 5/2002 | Smith |
| 6,399,853 | B1 | 6/2002 | Roe et al. |
| 6,404,837 | B1 | 6/2002 | Thompson et al. |
| 6,426,701 | B1 | 7/2002 | Levy et al. |
| 6,485,979 | B1 | 11/2002 | Kippenhan et al. |
| 6,519,505 | B2 | 2/2003 | Formon |
| 6,524,390 | B1 | 2/2003 | Jones |
| 6,718,341 | B1 | 4/2004 | Berstis et al. |
| 6,727,818 | B1 | 4/2004 | Wildman et al. |
| 7,015,816 | B2 | 3/2006 | Wildman et al. |
| 7,248,933 | B2 | 7/2007 | Wildman |
| 7,408,470 | B2 | 8/2008 | Wildman et al. |
| 7,450,024 | B2 | 11/2008 | Wildman et al. |
| 7,812,730 | B2 | 10/2010 | Wildman et al. |
| 8,368,544 | B2 | 2/2013 | Wildman et al. |
| 8,598,996 | B2 | 12/2013 | Wildman et al. |
| 9,349,267 | B2 | 5/2016 | Wildman et al. |
| 9,396,638 | B2 | 7/2016 | Wildman et al. |
| 2004/0198158 | A1 | 10/2004 | Driscoll et al. |
| 2006/0132316 | A1 | 6/2006 | Wildman et al. |
| 2008/0001763 | A1* | 1/2008 | Raja ..... A61L 2/18 340/573.1 |
| 2010/0164728 | A1* | 7/2010 | Plost ..... G08B 21/245 340/573.1 |
| 2011/0121974 | A1 | 5/2011 | Tenarvitz et al. |
| 2013/0120142 | A1 | 5/2013 | Wildman et al. |
| 2014/0266732 | A1* | 9/2014 | Barbeau ..... G06F 19/327 340/573.1 |
| 2014/0292518 | A1 | 10/2014 | Wildman et al. |

FOREIGN PATENT DOCUMENTS

| | | |
|---|---|---|
| GB | 2324397 | 10/1998 |
| GB | 2328867 A | 3/1999 |
| WO | WO 93/10311 | 5/1993 |
| WO | WO 97/31350 | 8/1997 |
| WO | 2014/145400 A1 | 9/2014 |

OTHER PUBLICATIONS

Carol Hildenbrand, *One Hand Better Wash the Other*, CIO Enterprise, Oct. 15, 1997 (1 page).

Kathleen G. Tatterson, *Employees Can't Wash Away Restroom Sensor*, Photonics Spectra, Jul. 1997 (1 page).

Marian Burros, *Wash Up: Big Brother Is Now in the Bathroom*, New York Times, Nov. 19, 1997 (1 page).

John Hendren, *Hand-washing detection system to get dirt on employees*, Business @marillo Globe-News, May 20, 1997 (3 pages).

Robert O'Harrow Jr., *Big Brother in the Bathroom*?, Washingtonpost.com, Aug. 30, 1997; p. A01 (3 pages).

Joni A. Mayer et al., *Increasing Handwashing in an Intensive Care Unit*, Infection Control 1986/vol. 7, No. 5 (4 pages).

Elaine Larson et al., *Effect of an Automated Sink on Handwashing Practices and Attitudes in High-Risk Units*, Infection Control and Hospital Epidemiology, Jul. 1991 (7 pages).

Elaine Larson, *Hand Washing—It's Essential—Even When You Use Gloves*, American Journal of Nursing, Jul. 1989 (8 pages).

Marian K. Fox et al., *How Good Are Hand Washing Practices*?, American Journal of Nursing, Sep. 1974 (3 pages).

William M. Marcil, *Handwashing Practices Among Occupational Therapy Personnel*, The American Journal of Occupational Therapy, vol. 47, No. 6, Jun. 1993 (6 pages).

*High-tech Hygiene: Monitoring System to Badger Employees Who Don't Wash Hands*, The Spokesman-Review, Sep. 1, 1997 (2 pages).

Business Wire, *Net/Tech to unveil patented Hygiene Guard Hand-Washing Monitoring System at the National Restaurant Show*, Apr. 3, 1997 (2 pages).

Hygiene Guard description from the Captology website, Stanford University, http://www-pcd.standford.edu/captology/resources/cep/catalog/hg.html, Oct. 9, 1999 ("Captology"), available at https://web.archive.org/web/19991009104253/http0://www-pcd.stanford.edu/captology/resources/cep/catalog/hg.html (1 page).

Broughall, et al., "An automatic monitoring system for measuring handwashing frequency in hospital wards," Journal of Hospital Infection (1984) 5, 447-453 (7 pages).

Pittet, "Improving Adherence to Hand Hygiene Practice: A Multidisciplinary Approach," Emerging Infectious Diseases, vol. 7, No. 2, Mar.-Apr. 2001 (7 pages).

(56) References Cited

OTHER PUBLICATIONS

"Cyro-Cell affiliate announces successful testing of world's first infrared hand washing monitoring system," memo, Business Wire, Inc., May 13, 1997 (1 page).

* cited by examiner

HYGIENE COMPLIANCE SYSTEM

The present application claims the benefit, under 35 U.S.C. §119(e), of U.S. Provisional Application No. 62/197,898, which was filed Jul. 28, 2015, and which is hereby incorporated by reference herein in its entirety.

BACKGROUND

The present disclosure relates to hygienic systems. More specifically, the present disclosure relates to hygiene compliance systems for monitoring and communicating hygiene activities, such as hand washing activities.

Handwashing can be an effective approach to control hygiene. Environments, such as healthcare facilities, inherently have contamination risks and often have patients with higher sensitivity to contamination. Numerous handwashes may be required to conform with good hygiene practices. However, it can be difficult in practice for caregivers to remember to perform the numerous handwashes during a course of performing seemingly innocuous activities, for example upon entry to a patient room. Caregivers and visitors alike can pose hygiene risks that may be different in degree and/or impact. Further, in administering care in a large capacity facility, such as a hospital, narrowing the root cause of a hygiene issue is difficult during the execution of many different activities and with the presence of both caregivers and visitors.

SUMMARY

The present application discloses one or more of the features recited in the appended claims and/or the following features which, alone or in any combination, may comprise patentable subject matter:

According to an aspect of the disclosure, a hygiene compliance system, includes a handwash sensor configured to transmit a handwash signal indicative of handwash device operation, at least one badge configured to transmit a signal, an occupant sensor configured to detect a number of persons in a predetermined proximity and to transmit an occupant signal indicative of the number of persons, and a remote computer configured to communicate with the handwash sensor and the occupant sensor, and the remote computer determines a hygiene compliance rate based on the handwash signal and the occupant signal.

In some embodiments, the remote computer includes a processor and a memory device, the memory device being configured to store instructions that when executed by the processor determine the hygiene compliance rate based on the handwash signal and the occupant signal.

In some embodiments, the hygiene compliance rate is based on a badged-handwash compliance rate comprising a number of badged-person handwash events compared to a number of required badged-person handwash events, and an unadjusted compliance rate comprising a number of total handwash events compared to a number of required total handwash events.

In some embodiments, the remote computer is configured to determine the number of required total handwash events based on the number of occupants detected by the occupant sensor.

In some embodiments, the hygiene compliance system further includes an interaction sensor, wherein the remote computer is configured to determine the number of required total handwash events based on an interaction signal from the interaction sensor indicative of interaction with a healthcare device.

In some embodiments, the hygiene compliance system further includes an interaction sensor configured to transmit an interaction signal indicative of interaction with the healthcare device.

In some embodiments, the healthcare device is a hospital bed and the interaction sensor is configured to detect interaction with the hospital bed and to transmit the interaction signal indicative of interaction with the hospital bed.

In some embodiments, the interaction sensor is configured to detect a movement of a siderail of the hospital bed and to transmit the interaction signal indicative of siderail movement.

In some embodiments, the interaction sensor is configured to transmit the interaction signal only if an exterior bed control is used to achieve the movement the siderail.

In some embodiments, the interaction sensor is configured to detect an adjustment of a position of a backrest of the hospital bed.

In some embodiments, the interaction sensor is configured to transmit the interaction signal only if an exterior bed control is used to achieve the adjustment of the position of the backrest of the hospital bed.

In some embodiments, the at least one badge, when within a predetermined proximity of the handwash sensor, receives a handwash sensor identification code and the handwash signal from the handwash sensor, and the at least one badge transmits a signal to the remote computer indicating the handwash sensor identification code, a badge identification code, and the handwash signal.

In some embodiments, the handwash sensor is configured to receive a badge identification code from the at least one badge being within a predetermined proximity of the handwash sensor, and to transmit a signal to the remote computer indicating a handwash sensor identification code, the badge identification code, and the handwash signal.

In some embodiments, the remote computer is configured to determine whether the hygiene compliance rate violates a threshold dictated by a hygiene operations scheme.

In some embodiments, the remote computer is configured to transmit an indicator signal indicating that the hygiene compliance rate violates the threshold to a local indicator to activate the local indicator to indicate non-compliance with the hygiene operation scheme.

In some embodiments, the predetermined proximity is a patient room of a hospital.

According to another aspect of the disclosure, a hygiene compliance system includes a handwash sensor configured to detect handwash device operation, at least one badge configured for signal transmission, an occupant sensor configured to detect a number of persons in a predetermined proximity, an interaction sensor configured to detect interaction with patient surroundings, and a remote computer configured to communicate with the handwash sensor, the occupant sensor, and the interaction sensor, and the remote computer determines a hygiene compliance rate based on the communications with the handwash sensor, the occupant sensor, and the interaction sensor.

In some embodiments, the predetermined proximity is a patient room of a hospital.

In some embodiments, the patient surroundings include a hospital bed and the interaction with patient surroundings includes adjustment of the position of the backrest of the hospital bed, and the interaction sensor is configured to communicate an interaction signal indicating the adjustment of the position of the backrest to the remote computer, and the remote computer determines the hygiene compliance rate based on the interaction signal.

According to another aspect of the disclosure, a hygiene compliance system includes a handwash sensor configured to transmit a handwash signal indicative of handwash device operation, at least one badge configured to transmit a signal, an occupant sensor configured to detect a number of persons in a predetermined proximity and to transmit an occupant signal indicative of the number of persons, and a remote computer configured to communicate with the handwash sensor and the occupant sensor. The remote computer determines a hygiene compliance rate based on the handwash signal, the occupant signal, and wash observation data from a third party observation information.

In some embodiments, the remote computer is configured to generate reports including a hygiene compliance rate associated with an individual caregiver and to automatically transmit a daily electronic message to the individual caregiver indicating the hygiene compliance rate associated with the individual caregiver.

In some embodiments, the remote computer is configured to automatically retrieve staff assignments from other hospital systems.

Additional features alone or in combination with any other feature(s), including those listed above and those listed in the claims and those described in detail below, can comprise patentable subject matter. Others will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION

Good hygiene can be encouraged by reminding persons to wash their hands. Monitoring handwashing to control hygiene and indicating locally when handwashing is advisable can assist in reminding persons within the area to wash their hands appropriately. In a patient care facility, such monitoring and communication can decrease hygiene related issues. A hygiene compliance system monitors activities relevant to hygiene and determines, according to a hygiene operation scheme, whether to provide local indication that handwashing should be performed. In illustrative embodiments, a hygiene compliance system 10 monitors hygiene within a care facility, such as a hospital, and provides local indication of hygiene compliance or lack thereof.

Figure 1:
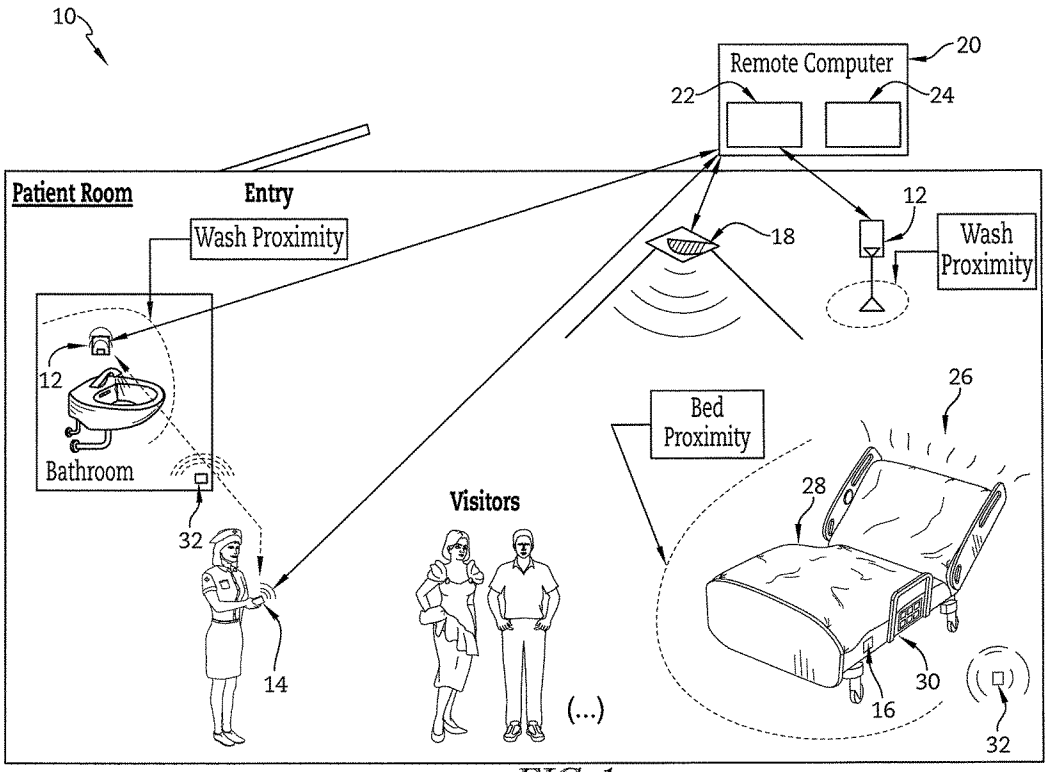
FIG. 1 is a diagrammatic view of a hygiene compliance system according to the present disclosure showing a badged caregiver and two non-badged visitors in a patient room, the patient room having equipment therein for monitoring handwashing compliance activities, and the equipment being in communication with a remote computer.

An illustrative hygiene compliance system 10 is shown in FIG. 1. The hygiene compliance system 10 includes a handwash sensor 12, a badge 14, an occupant sensor 18, and a remote computer 20. The hygiene compliance system 10 monitors handwash events and determines whether minimum standards of hygiene have been achieved. If minimum standards are not achieved, the hygiene compliance system 10 provides a local indication of non-compliant hygiene conditions.

The handwash sensor 12 is configured to detect operation of a handwash device, such as a sink or a soap, foam or gel dispenser, as a handwash event and to communicate the detected operation of the handwash device to the remote computer 20. The handwash event is illustratively embodied as operation of a soap dispenser operation. The remote computer 20 determines a hygiene compliance rate and/or compliance index based on the information from at least one of the handwash sensor 12 and the occupant sensor 18 for local indication of compliance or non-compliance with a hygiene operation scheme.

The occupant sensor 18 of the hygiene compliance system 10 detects the number of occupants within a predetermined proximity as suggested in FIG. 1. The occupant sensor 18 communicates the detected number of occupants to the remote computer 20 as suggested in FIG. 1. The remote computer 20 determines compliance with the hygiene operations scheme based on the information received from the occupant sensor 18.

The remote computer 20 receives communication signals from any of the handwash sensor 12, the badge 14, and the occupant sensor 18. The remote computer 20 is configured to monitor compliance with the hygiene operations scheme. The remote computer 20 compares information received from the communications signals and determines whether compliance with the hygiene operation scheme has been achieved. Upon successful compliance with the hygiene operation scheme, a local indicator 26 is operated to signal compliance.

When it is stated that the remote computer 20 receives signals from badge 14, it should be appreciated that badge 14 is included as part of a locating system, sometimes referred to as a real time locating system (RTLS), that includes intervening equipment between badge 14 and computer 20. For example, receivers of an RTLS are placed within rooms to receive signals from badges 14 and the receivers are coupled, either via wired connections or wirelessly, to gateways and/or servers. Thus, in some embodiments computer 20 is included as part of the RTLS and in other embodiments, computer 20 communicates with a server of the RTLS. Occupant sensor 18 is also considered to be part of the RTLS in some embodiments. However, its purpose is to sense all occupants in a room and not just those with badges 14. Thus, in the FIG. 1 example, occupant sensor 18 senses the presence of the caregiver transporting badge 14 and the two visitors who do not have badges (e.g., non-badged persons).

The hygiene operations scheme is a system of hygiene compliance rules or protocols for maintaining and monitoring hygiene within a facility and/or system. For example, the hygiene operations scheme may require badged-room occupants (for example caregivers) of a hospital to wash their hands upon entry into a patient room. The hygiene operations scheme may be implemented through the remote computer 20 which receives information through communication signals from various sensors (such as those discussed above) and determines whether the information received indicates compliance with the hygiene operations scheme.

In illustrative embodiments, the hygiene operations scheme is stored on the remote computer 20. The hygiene operations scheme illustratively combines hygiene requirements of badged persons (such as caregivers) and hygiene requirements of general occupants (including all badged and non-badged persons such as caregivers and visitors) to dictate whether hygienic conditions are acceptable. Illustratively, the remote computer 20 monitors the hygiene of badged persons via communications from the badge 14 while general occupant hygiene is illustratively monitored for compliance by the remote computer 20 based on communications from the occupant sensor 18 and the handwash sensor 12. By monitoring hygiene for both badged persons (such as caregivers) and non-badged persons (such as visitors), hygiene monitoring system 10 can effectively monitor all persons occupying an area to provide a more complete hygiene assessment tool. Integrating badged hygiene tracking with general hygiene tracking can create a more accurate hygiene assessment tool by integrating high and low precision and/or resolution tools and can provide more accurate local indication of hygiene compliance. Such combined hygiene tracking can allow cost-effective implementation while providing an ability to narrow the source of contamination and create detailed reporting.

In illustrative embodiments, the remote computer 20 monitors badged persons' hygiene for compliance with the hygiene operations scheme as suggested in FIG. 1. A badged-person handwash event occurs when a badged person enters a wash proximity of the handwash sensor 12, the handwash sensor 12 detects operation of the handwash device, and the badge 14 receives information from the handwash sensor 12 indicating the handwash device has been operated. In some embodiments, the badge 14 illustratively reads an identification code of the handwash sensor 12, receives a signal from the handwash sensor 12 indicating operation of the handwash device, and transmits a compliance signal that includes the identification codes of the handwash sensor 12 and the badge 14, and an indication that the handwash device has been operated. The remote computer 20 stores the information received from the badge 14.

In illustrative embodiments, the remote computer 20 monitors general person hygiene based on communications from the occupant sensor 18 and the handwash sensor 12 as suggested in FIG. 1. The occupant sensor 18 illustratively detects the number of persons within a predetermined proximity, such as a patient room, and communicates the determined number of persons to the remote computer 20 as suggested in FIG. 1. In some embodiments, the occupant sensor 18 may be configured to detect entry and exit events from the patient room. For example, infrared (IR) light beam emitters and receivers placed within or near a doorway serve as occupant sensor 18 in some embodiments and are capable of sensing entry and exit of people relative to the room based on the sequence in which two or more light beams are interrupted. Another example of an occupant sensor 18 includes a camera of the type that senses heat signatures of people in a room or a regular camera in combination with software that processes the images received from the camera to determine the number of people in the room.

A general handwash event occurs when the handwash sensor 12 detects operation of the handwash device without a badge 14 within the wash proximity. The handwash sensor 12 communicates with the remote computer 20 to indicate operation of the handwash device. The remote computer 20 illustratively receives communication signals from the handwash sensor 12 indicating handwash device operation without a badge identification code, and from the occupant sensor 18 indicating the number of persons within the patient room.

In illustrative embodiments, the remote computer 20 determines a hygiene compliance rate based on the communication signals received. The remote computer 20 illustratively determines the hygiene compliance rate based on a combination of a badged-person compliance rate and an unadjusted compliance rate. The remote computer 20 illustratively determines the badged-person compliance rate based on the number of badged-person handwash events communicated by the handwash sensor 12 as a portion of the required badged-handwash events according to the hygiene operations scheme. For example, if the hygiene operations scheme dictates 13 required badged-person handwash events (caregiver handwash events) under given conditions, and only eleven badged-person handwash events were communicated to the remote computer 20 from two different badge identification numbers, the badged-person compliance rate, as a percentage is determined to be $100\times 11/13=84.6\%$.

In illustrative embodiments, the remote computer 20 determines the unadjusted compliance rate based on the number of general occupants as determined by the occupant sensor 18 and the number of general handwash events as communicated from the handwash sensor 12 to the remote computer 20. For example, during the same period of time as the example above, if the occupant sensor 18 detects there are seven general occupants in the patient room and the remote computer 20 determines that the hygiene operation scheme dictates a required 25 general-person handwash events under the given conditions, and the handwash sensor 12 communicated 17 general handwash events, the unadjusted compliance rate, as a per centage, would be $100\times 17/25=68\%$. However, as discussed above, because the badged-person compliance rate was determined to be $11/13$, eleven of the 17 total sensed handwash events were badged-handwash events, the remote computer 20 would then determine a non-badged compliance rate, as a per centage, to be $100\times 6/25=24\%$.

In this example, the remote computer 20 determines the hygiene compliance rate, as a per centage, to be 100×17 total handwashes/(25 general handwashes required+13 badged-handwashes required)=>100×17 achieved/38 total required handwashes)=44.7%. The given example is not intended to provide limitation to the methodology that may be used in determining compliance rates and is intended only to provide a baseline example. In some embodiments, any of the compliance rates may be determined by any number of statistical evaluations and/or adjustments based on historic, current, or predictive information and/or communications generated or received by the remote computer 20. In some embodiments, the remote computer 20 may consider the number of badge identification numbers contributing to the total badged-person compliance rate in determining any of the required general-person handwash events, the non-badged compliance rate, the unadjusted compliance rate, and/or the hygiene compliance rate.

In illustrative embodiments, the remote computer 20 receives communication signals from any of the handwash sensor 12, badge 14, and occupant sensor 18. The remote computer 20 stores information from the received communication signals and determines the compliance rates based on the stored information. The remote computer 20 illustratively includes a memory device 22 and processing unit 24 as suggested in FIG. 1. The memory device 22 stores the information received by the remote computer 20 and instructions for execution by the processing unit 24 to determine whether the information received by the remote computer 20 complies with the hygiene operations scheme. In some embodiments, the remote computer 20 may include any number of servers, databases, balancers, accelerators, replicator and/or other hardware and/or software devices to facilitate the remote computer operations described herein.

The memory device 22 is configured to store the instructions for execution by the processing unit 24. The memory device 22 illustratively stores the hygiene operations scheme for query by the processing unit 24 and response thereto. In illustrative embodiments, the instructions include at least one algorithm configured to determine the hygiene compliance rate based on the communication signals received by the remote computer 20. In some embodiments, the instructions may include reference charts, lookup tables, or the like and may be configured to be updated through a communication link (not shown) to support debugging, enhanced features, and or updated control design. In some embodiments, the memory device 22 may include one or more volatile and/or non-volatile storage devices including local and/or remote storage devices and may include one or more devices that are dedicated and/or shared between other hospital systems. For example, the memory device 22 may include multiple dedicated memory devices of different hospital systems that may be configured for communication therebetween, including importing and exporting of stored information, whether manually or automatically.

The processing unit 24 of the remote computer 20 is configured to receive communication signals from any of the handwash sensor 12, the badge 14, and the occupant sensor 18 for storage as information in the memory device 22; to query the memory device 22 and receive responses; to determine compliance with the hygiene operations scheme based on the information stored; and to output an indicator signal to communicate compliance or noncompliance with the hygiene operation scheme. In illustrative embodiments, the processing unit 24 is a microprocessor or a microcontroller. In some embodiments, the processing unit 24 may include one or more processing devices including local and/or remote processors and may include one or more devices that are dedicated and/or shared between other hospital systems. For example, the processing unit 24 may include multiple dedicated processing devices of different hospital systems that may be configured for communication therebetween and/or for communication with memory devices of other hospital systems.

Figure 2:
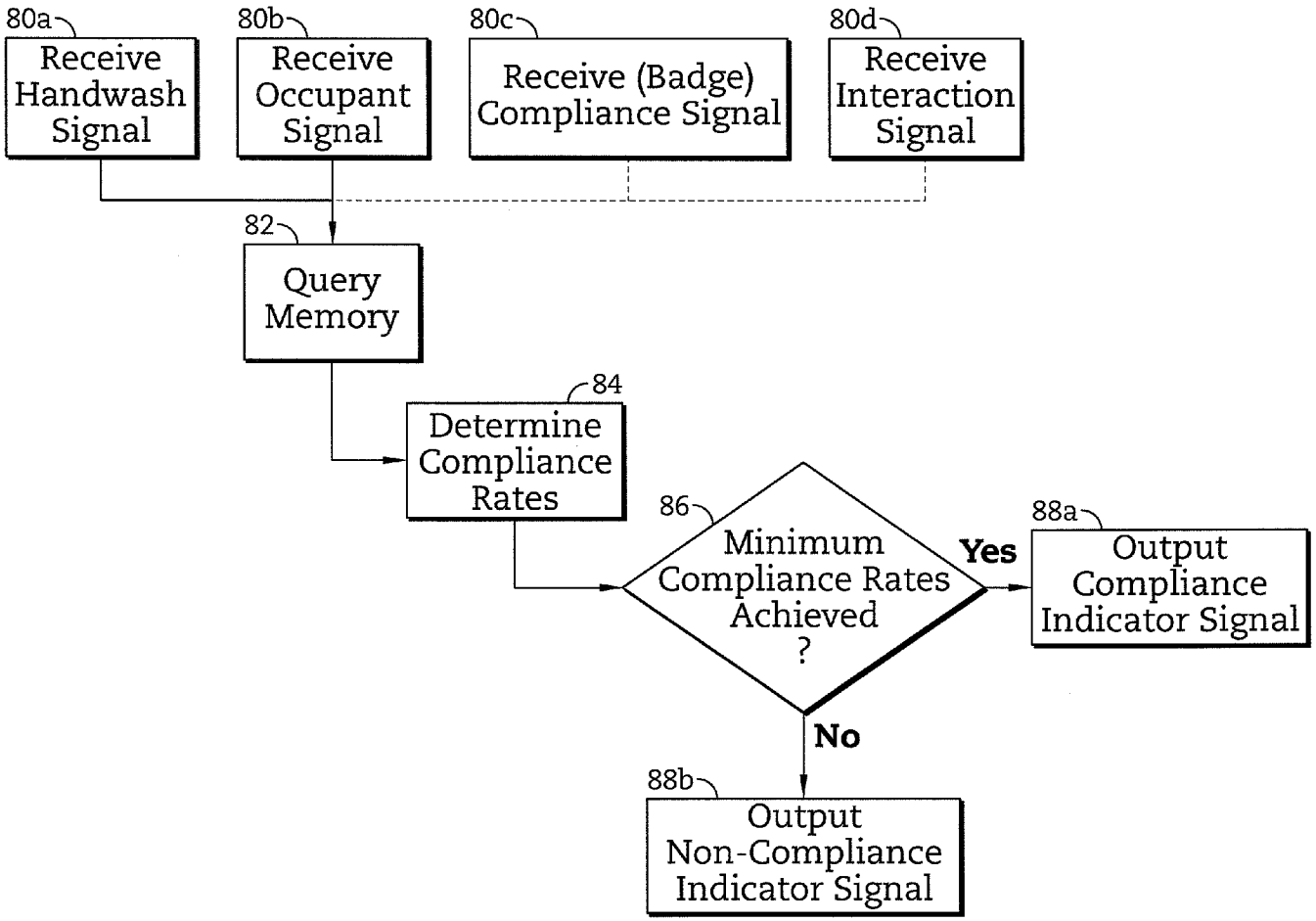
FIG. 2 is a flow chart of an algorithm of the hygiene compliance system of FIG. 1 for determining handwashing compliance rates and whether to provide an indicator signal regarding compliance and non-compliance with handwashing protocols.

In some embodiments as suggested in FIG. 2, the processing unit 24 receives communication signals from any of the handwash sensor 12, the badge 14, and the occupant sensor 18 indicating the communications from each as indicated at blocks 80*a-c*. The processing unit 24 illustratively communicates the information indicated by the communication signals to the memory device 22 for storage. As indicated at block 82, the processing unit 24 illustratively queries the memory device 22 for the stored information of the communication signals and the required minimum compliance rates based on the information. Next, as indicated at block 84, the processing unit 24 illustratively executes the instructions stored in the memory device 22 based on the stored information of the communication signals to determine the badged-person compliance rate, the unadjusted occupant compliance rate, and the hygiene compliance rate, such as by using the methodology discussed above.

As indicated at block 86 which follows block 84, the processing unit 24 determines whether the compliance rates are less than the minimum compliance rates. Minimum compliance rates are illustratively embodied as fixed values predetermined by configuration of the hygiene operations scheme, for example as set by an administrator. In some embodiments, minimum compliance rates may be determined by the processing unit 24 based on inputs from one or more hospital systems. In some embodiments, the processing unit 24 may execute hygiene operations instructions stored on the memory device 22 to determine the minimum required compliance rates and/or required handwash events as dictated by the hygiene operations scheme. The processing unit 24 illustratively compares the determined compliance rates to the required minimum compliance rates.

In illustrative embodiments as suggested in FIG. 2, if the processing unit 24 determines each minimum required compliance rate has been achieved, the processing unit 24 illustratively outputs an indicator signal for compliance as indicated at block 88*a*. If the processing unit 24 determines any minimum required compliance rate has not been achieved, the processing unit 24 illustratively outputs a non-compliance indicator signal as indicated at block 88*b*. In some embodiments, the remote computer 20 may output compliance and non-compliance indicator signals to the local indicator 26 to communicate locally whether required minimum compliance rates have been achieved. In some embodiments, the remote computer 20 may be configured to communicate a non-compliance indicator signal at all times unless and until compliance with all minimum required compliance rates has been achieved at which time a compliance indicator signal is communicated.

In illustrative embodiments as suggested in FIG. 1, the local indicator 26 includes a light source which illuminates to indicate that the determined compliance rates are in compliance or non-compliance with the required minimum compliance rates of the hygiene operation scheme. In illustrative embodiments, the local indicator 26 receives the indicator signal from the remote computer 20 indicating either compliance or non-compliance with the minimum required compliance rates. In illustrative embodiments, local indicator 26 may be attached to equipment within the patient room, for example, a hospital bed, and/or may be carried by a badged person (caregiver), for example, as attached to the badge 14. In some embodiments, the remote computer 20 may be configured to transmit different indicator signals to different local indicators 26, for example, an non-compliance indicator signal which is only relevant to a badged person because the badged person is no longer in any patient rooms may be communicated only to the local indicator 26 carried by the badged person.

In some embodiments, the local indicator 26 illuminates green when all required minimum compliance rates have been achieved. The local indicator 26 illustratively illuminates red when any required minimum compliance rates have not been achieved. In some embodiments, the local indicator 26 may include any other component and/or process to indicate compliance and/or non-compliance with the hygiene operation scheme including but not limited to any visual and audio indications with varying rates and/or intensities and may be configured to indicate compliance and/or non-compliance with multiple requirements of the hygiene operations scheme through different and/or varying indications, for example, illuminating a yellow color to indicate achievement of minimally required, but not preferred, compliance rates. In some embodiments, a graphical user interface (GUI) included on the bed or mounted on a room wall serves as indicator 26. In such embodiments, textual information regarding compliance and non-compliance is displayed on the GUI.

Figure 6:
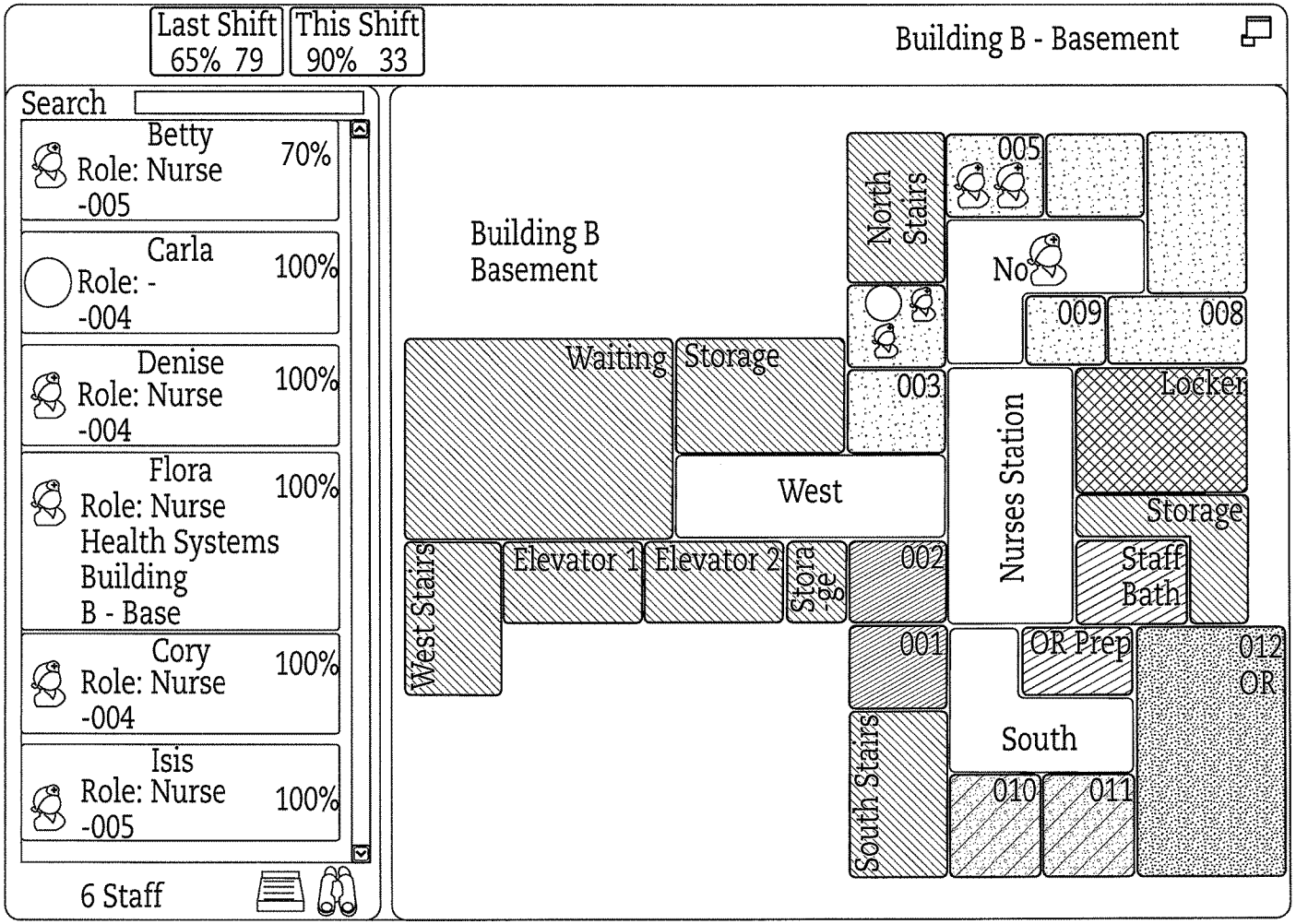
FIG. 6 is a screen shot of a hygiene report showing a map with locations of caregivers and a list of compliance percent information to the left of the map.

The remote computer 20 illustratively can be accessed by an authorized user (such as a caregiver) to review historic hygiene information including handwashing events and types (e.g., types of handwash devices, badged and/or general handwash events), compliance rates, numbers of occupants and other information communicated thereto and may select criterion with which to delimit the return information. An authorized user can select a time period across which to review the historical hygiene information to provide an ability to narrow contamination sources and otherwise review overall hygiene compliance trends, for example by hour, shift, day, or month. An authorized user can select one or more occupant specific criterion across which to review the historical hygiene information to provide an ability to narrow contamination sources and otherwise review overall hygiene compliance trends, for example by badge number, caregiver role, hospital unit, floor, room, patient, etc. The remote computer 20 is configured to provide customizable hygiene reports indicating historical hygiene information for selected time periods. The remote computer 20 is configured to display a map of at least portions of the care facility, for example, a portion of a specific floor as selected by an authorized user, and to display the historic hygiene information as delimited including percentages on the map for review, as shown, for example, in FIG. 6. In FIG. 6, different fill patterns in the various rooms on the map illustratively indicates different compliance rates of the different areas but compliance rates for different areas may be indicated in any suitable form such as with coloration or display of actual compliance rate within each of the areas (e.g., rooms) of the map.

The remote computer 20 may be configured to output messages indicating the compliance reports including historic hygiene information with selected delimitations and to send such reports automatically to indicated users. For example, computer 20 is configurable to send an e-mail message to a designated computer device (e.g., personal computer, tablet computer, smart phone, etc.) of a caregiver with her daily compliance rate, and with the compliance rate of her overall unit for the week. The remote computer 20 is configured to permit user-configuration of the messages and the frequency of the messages (e.g., daily, hourly, at the end of each shift, and so forth) to assist in communicating hygiene information. In connection with the monitored and e-mailed compliance rate information, in some embodiments, this is a per centage as compared to an adherence goal that is less than 100%. For example, if a caregiver has an adherence goal of 70% but only washes his or her hands 35% of the time that a handwashing protocol dictates, then the caregiver is 50% adherent as compared to the goal of 70%. The % compliant toward an adherence goal is the % that is e-mailed to caregivers in some embodiments.

In illustrative embodiments, the handwash sensor 12 includes a radar-based activation sensor of a touchless soap dispenser that activates the dispenser and communicates its identification code and dispenser operation to the remote computer 20, as suggested in FIG. 1. The handwash sensor 12 illustratively communicates dispenser operation and the handwash sensor identification code to the badge 14 by low frequency (RF). In some embodiments, the handwash sensor 12 may include one or more of radar, photo, infrared, thermal, and/or any other type of activation sensor to determine operation of the dispenser. In some embodiments, the handwash sensor 12 may include multiple handwash sensors 12 associated with different handwash devices of the same patient room, for example, a patient room may have multiple sinks each with a soap dispenser, and a standalone waterless sanitizer dispenser, where each soap dispenser and sanitizer dispenser includes a handwash sensor 12 communicating its operation to the remote computer 20.

In illustrative embodiments, the occupant sensor 18 is a dedicated thermal imaging device configured to detect the number of occupants in a patient room. In some embodiments, the occupant sensor 18 may be configured to detect entry and exit of occupants to and from a given area for recording entry and exit events respectively. In some embodiments, the occupant sensor 18 may include one or more beam counters, video/visual counters, any other combinations of hardware and/or software to detect the number of persons within the given area and/or entry and exit events form the given area, and/or any combinations thereof. In some embodiments, the occupant sensor 18 includes a processor and memory and/or may rely on the remote computer 20 for the same. In some embodiments, the occupant sensor 18 may be a combined sensor used with multiple systems requiring occupancy information.

Figure 3:
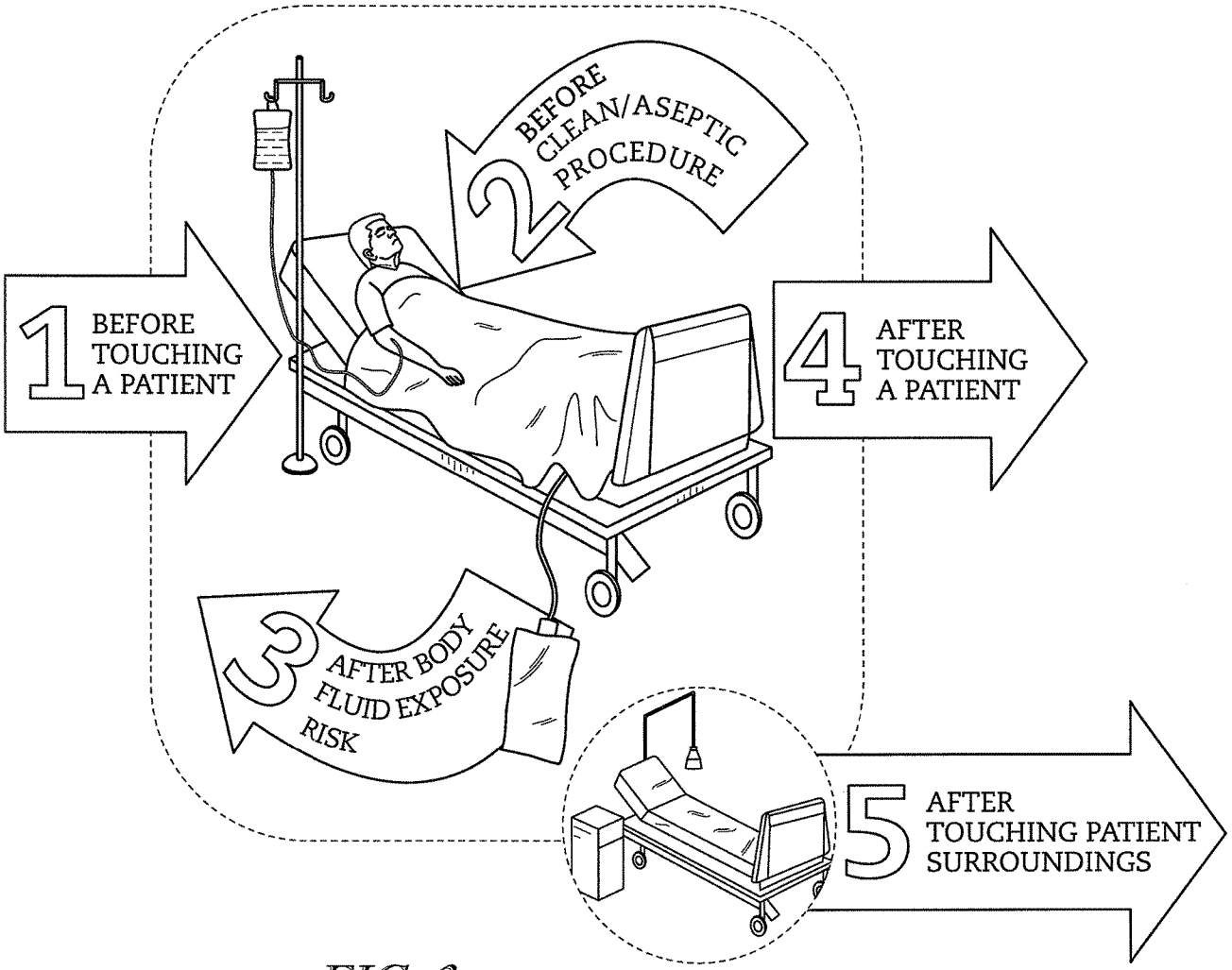
FIG. 3 is a diagrammatic view showing moments of hand hygiene consideration that indicate when a caregiver should potentially wash his or her hands in a healthcare environment.

The World Health Organization (WHO) recommends consideration of five moments of exposure including before touching a patient, before a clean procedure, after body fluid exposure, after touching a patient, and after touching patient surroundings as suggested in FIG. 3. In illustrative embodiments, the hygiene operations scheme includes a system of hygiene compliance rules for dictating the quantity and/or timing of required handwashing events. The hygiene operations scheme illustratively incorporates one or more rules for assessing the likelihood of contamination exposure and dictating the quantity and/or timing of required handwash events.

In illustrative embodiments, the hygiene operations scheme dictates the required badged-person handwash events based on the locations within a patient room through which the badge 14 passes as detected by various badge proximity sensors 32 illustratively positioned in hygiene sensitive areas throughout the patient room as suggested in FIG. 1. An example of such an arrangement can be found as disclosed in U.S. Pat. No. 8,368,544 issued to Wildman et al., the contents of which are hereby incorporated by reference in their entirety. The remote computer 20 illustratively records badged-person exposure events and determines required handwash events as dictated by the hygiene operations scheme. The remote computer 20 marks each badged person exposure event as "Compliant" or "Not Compliant" based on whether the required badged-person handwash events are satisfied by communication of badged-person handwash operation.

In illustrative embodiments, the hygiene operations scheme dictates the required badged-person handwash events, the required general-person handwash events, and the minimum compliance rates based on patient surroundings events (PSE) as indicated by one or more interaction sensors 16 of the hygiene compliance system 10. The interaction sensors 16 are configured to detect interaction with patient surroundings for recording as PSE's by the remote computer 20 as suggested in FIG. 1 in which sensor 16 is included as part of a hospital bed.

The interaction sensors 16 are illustratively configured to detect occupant interaction with a healthcare device and to communicate an interaction signal (illustratively shown as block 80*d* of FIG. 2) indicating such occupant interaction to the remote computer 20 as suggested in FIGS. 1, 2, and 4A-5H. The remote computer 20 illustratively receives communication of the interaction signal indicating occupant interaction with patient surroundings and records a patient surroundings event (PSE) as dictated by the hygiene operations scheme. If the remote computer 20 determines that any hygiene threshold dictated by the hygiene operation scheme has been violated, the remote computer 20 illustratively communicates an indicator signal to the local indicator 26. The hygiene thresholds are illustratively embodied as the minimum compliance rates discussed above and violation is illustratively embodied as falling below the minimum compliance rates. In some embodiments, the hygiene thresholds may be one or more quality, quantity, and/or time thresholds related to handwash events and/or any combinations thereof.

In illustrative embodiments, if a badge 14 is within a predetermined interaction proximity from the interaction sensor 16 during detection of the occupant interaction, the badge 14 receives an identification code of the interaction sensor 16 and the interaction signal for communication to the remote computer 20. Illustratively, if no badge 14 is within the predetermined interaction proximity from the interaction sensor 16 during detection of the occupant interaction, the interaction sensor 16 transmits the interaction signal to the remote computer 20. The remote computer 20 illustratively receives the interaction signal, stores information based on the interaction signal, determines the required handwash events as dictated by the hygiene operations scheme and determines the minimum required compliance rates based on the interaction signal. The remote computer 20 illustratively marks each PSE as "Compliant" or "Not Compliant" based on whether the required badged-person handwash events are satisfied by communication of badged person handwash operation.

In illustrative embodiments, the healthcare device is a hospital bed 28 as shown in FIG. 1. The interaction sensor 16 is illustratively configured to detect a movement of a siderail of bed 28, and to communicate an interaction signal indicating the movement of the siderail. In some embodiments, the interaction sensor 16 is configured to detect adjustment of a position of a backrest (a.k.a. a head section) of the hospital bed 28, and to communicate an interaction signal indicating that the position of the backrest has been adjusted. In some embodiments, the interaction sensor is configured to communicate an interaction signal indicating occupant interaction has occurred only if interaction has occurred by external bed controls 30 which are conveniently accessible to persons not occupying the bed 28 and typically face away from the patient on a mattress of bed 28, as opposed to interior patient bed controls which are conveniently located for persons occupying the bed 28 and typically face toward the patient on bed 28. In illustrative embodiments, the interaction sensor 16 is a position sensor configured to detect the position of the siderails and/or backrest of the bed 28. In some embodiments, the interaction sensor 16 may include a portion of bed control circuitry. In some embodiments, the interaction sensor 16 may include one or more interaction sensors 16 for detecting occupant interaction with a healthcare device.

In illustrative embodiments as suggested in FIGS. 4A-4G, the hygiene operations scheme dictates the required badged-person handwash events based on detected patient surroundings events (PSE) in which interaction sensors 16 indicate interaction with a healthcare device. Illustratively, if the remote computer 20 records a PSE, and after a predetermined amount of time from the occurrence of the PSE no handwash event is communicated to the remote computer 20, the remote computer marks the PSE as "Not Compliant." The predetermined amounts of time from a PSE may vary according to various factors including the type and/or location of PSE detected as dictated by the hygiene operation scheme. Marking and recording by the remote computer 20 illustratively include storage in the memory device 22 with the associated designation. If the remote computer 20 determines that any hygiene threshold (as dictated by the hygiene operation scheme) has been exceeded, the remote computer 20 illustratively communicates an indicator signal to the local indicator 26 to indicate non-compliance. FIGS. 4A-4G depict a sequence of exemplary actions of a badged person (caregiver carrying a badge 14) triggering PSE's and exemplary responses of the hygiene compliance system 10.

Figure 4A:
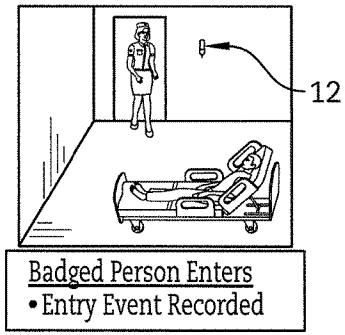
FIGS. 4A-4G are scenes of a pictorial flow diagram of exemplary sets of events involving a badged caregiver and responses of the hygiene compliance system of FIG. 1 based on the events.
Figure 4B:
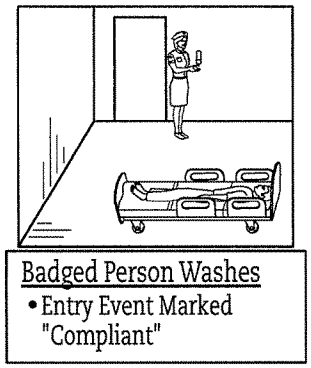

In FIG. 4A, a badged person enters the patient room. The occupant sensor 18 illustratively detects the entry event and communicates the entry event to the remote computer 20 for recording in the memory device 22. In FIG. 4B, the badged person washes her hands within the predetermined amount of time from the entry event. A handwash sensor 12 illustratively detects operation of the handwash device and transmits a handwash signal to a badge 14 carried by the badged person. The badge 14 illustratively receives the handwash signal and the identification code of the handwash sensor 12, and transmits a compliance signal to a remote computer 20. The remote computer 20 illustratively marks the recorded entry event as "Compliant."

Figure 4C:
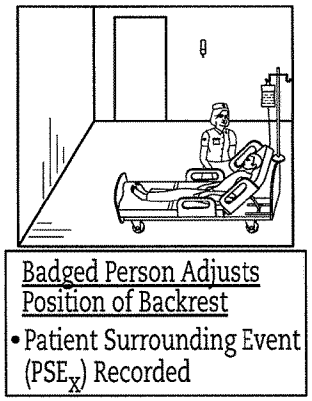

In FIG. 4C, the badged person adjusts a position of a backrest of a hospital bed 28 of the patient using external bed controls 30. An interaction sensor 16 illustratively detects the adjustment of the backrest of the bed 28 and communicates an interaction signal to the badge 14 indicating the adjustment has occurred. The badge 14 illustratively receives the interaction signal, an identification code of the interaction sensor 16, and transmits a signal to the remote computer 20 indicating the interaction signal, the identification code of the interaction sensor 16, and the identification code of the badge 14. The remote computer 20 illustratively receives the signal from the badge 14 and records the $PSE_x$ in the memory device 22.

Figure 4D:
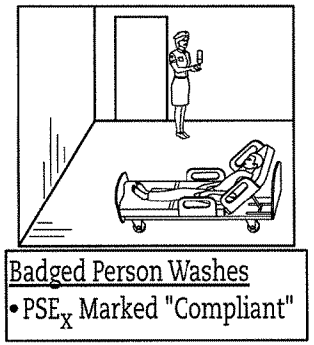

In FIG. 4D, the badged person washes her hands within the predetermined amount of time from $PSE_x$. The handwash sensor 12 illustratively detects operation of the handwash device and transmits a handwash signal to a badge 14 carried by the badged person. The badge 14 illustratively receives the handwash signal and the identification code of the handwash sensor 12, and transmits a compliance signal to a remote computer 20. The remote computer 20 illustratively marks the recorded $PSE_x$ as "Compliant."

Figure 4E:
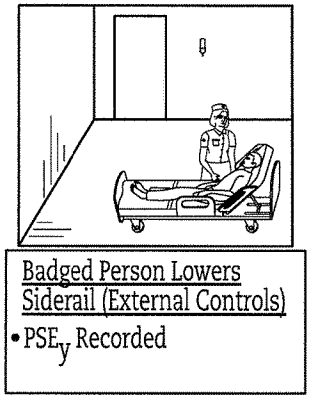
Figure 4F:
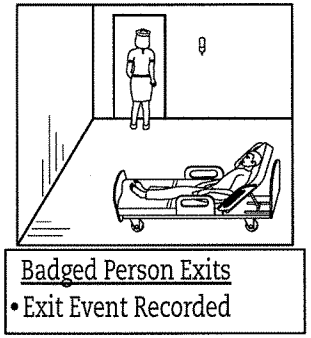

In FIG. 4E, the badged person moves a siderail of the hospital bed 28 such as by manually raising the siderail 30 from a lowered position to a raised position or vice versa. The interaction sensor 16 illustratively detects the movement of the siderail and communicates an interaction signal to the badge 14 indicating the movement has occurred. The badge 14 illustratively receives the interaction signal and the identification code of the interaction sensor 16, and transmits a signal to the remote computer 20 indicating the interaction signal, the identification code of the interaction sensor 16, and the identification code of the badge 14. The remote computer 20 illustratively receives the signal from the badge 14 and records the siderail movement as $PSE_y$. In FIG. 4F, the badged person exits the patient room. The occupant sensor 18 illustratively detects the exit event and communicates the exit event to the remote computer 20 for recording in the memory device 22.

Figure 4G:
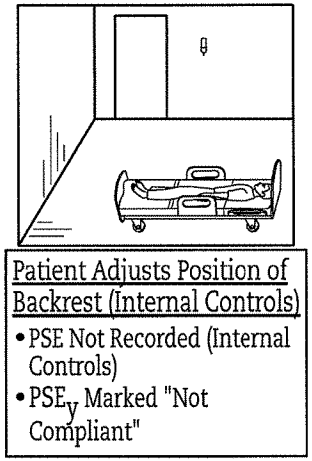

In FIG. 4G, the patient adjusts the position of the backrest of the bed 28 using internal patient bed controls. The interaction sensor 16 illustratively detects the adjustment of the backrest but does not transmit a signal to the remote computer 20 because the external bed controls were not operated. Thus, use of the internal controls of bed 28 by the patient is not considered to constitute a PSE that requires a subsequent handwash in some embodiments. Illustratively, after a predetermined amount of time, the remote computer 20 marks the $PSE_y$ (e.g., the siderail movement event) as "Not Compliant." If the remote computer determines that the $PSE_y$ being "Not Compliant" accumulates to violate a hygiene threshold according to the hygiene operations scheme, the remote computer 20 transmits an indicator signal to the local indicator 26 to indicate non-compliance.

In illustrative embodiments as suggested in FIGS. 5A-5H, the hygiene operations scheme dictates the required badged-person handwash events, required general-person handwash events, and the minimum compliance rates based on detected patient surroundings events (PSE) in which interaction sensors 16 indicate an occupant requires handwashing. Illustratively, if the remote computer 20 records a PSE which is not marked "Compliant" within a predetermined time period, the remote computer marks the PSE "Not Compliant." The predetermined amounts of time from a PSE may varying according to various factors including the type and/or location of PSE detected as dictated by the hygiene operation scheme. Marking and recording by the remote computer 20 illustratively include storage in the memory device 22 with the associated designation. When the remote computer 20 determines that a hygiene threshold (as dictated by the hygiene operation scheme) has been violated, the remote computer 20 illustratively communicates an indicator signal to the local indicator 26. The hygiene thresholds are illustratively embodied as the minimum compliance rates discussed above. In some embodiments, the hygiene thresholds may be one or more quality, quantity, and/or time thresholds related to handwash events and/or any combinations thereof. FIGS. 5A-5H depicts a sequence of exemplary actions of a badged person (caregiver carrying a badge 14) and two general occupants (visitors) triggering PSE's and exemplary responses of the hygiene compliance system 10.

Figure 5A:
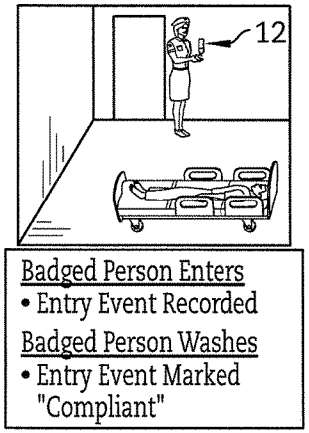
FIGS. 5A-5H are scenes of a pictorial flow diagram of exemplary sets of events involving a badged caregiver and two visitors and responses of the hygiene compliance system of FIG. 1 based on the events.

In FIG. 5A, a badged person enters the patient room and washes her hands within the predetermined amount of time from her entry. The occupant sensor 18 illustratively detects the entry event and communicates the entry event to the remote computer 20 for recording in the memory device 22. The handwash sensor 12 illustratively detects operation of the handwash device and transmits a handwash signal to the badge 14 carried by the badged person. The badge 14 illustratively receives the handwash signal and the identification code of the handwash sensor 12, and transmits a compliance signal to a remote computer 20. The remote computer 20 illustratively marks the recorded entry event as "Compliant."

Figure 5B:
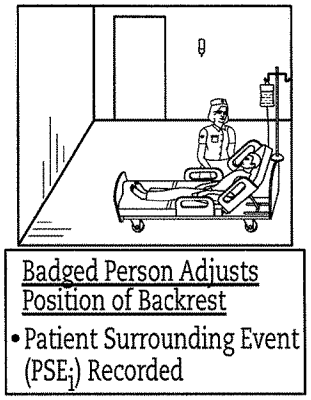
Figure 5C:
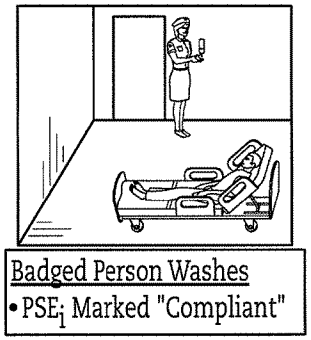

In FIG. 5B, the badged person adjusts a position of a backrest of a hospital bed 28 using external bed controls 30. An interaction sensor 16 illustratively detects the adjustment of the backrest of the bed 28 and communicates a signal to the remote computer 20 indicating the adjustment has occurred for recording as $PSE_i$ in the memory device 22. In FIG. 5C, the badged person washes her hands within the predetermined amount of time from the $PSE_i$. The handwash sensor 12 illustratively detects operation of the handwash device and transmits a handwash signal to the badge 14 carried by the badged person. The badge 14 illustratively receives the handwash signal and the identification code of the handwash sensor 12, and transmits a compliance signal to the remote computer 20. The remote computer 20 marks the recorded $PSE_i$ as "Compliant."

Figure 5D:
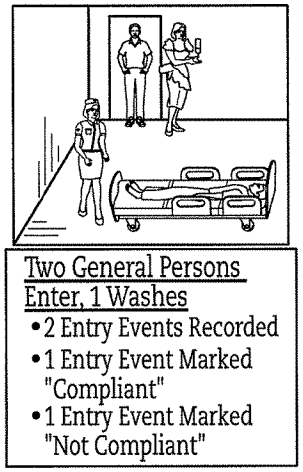

In FIG. 5D, first and second general occupants (e.g., visitors or non-badged hospital personnel) enter the patient room, only one of which washes her hands within the predetermined amount of time from the first entry. The occupant sensor 18 illustratively detects the first and second entry events and communicates the entry events to the remote computer 20 for recording in the memory device 22. The handwash sensor 12 illustratively detects a single operation of the handwash device and transmits a handwash signal to the remote computer 20. The remote computer 20 illustratively marks the first of the recorded entry events as "Compliant." Illustratively, after a predetermined amount of time, the remote computer 20 marks the second entry event as "Not Compliant."

Figure 5E:
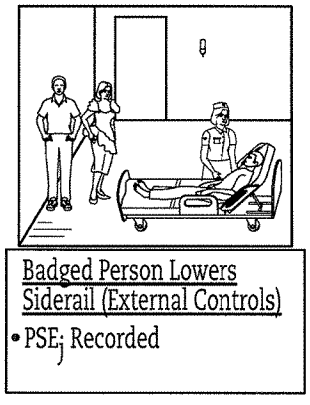

In FIG. 5E, the badged person lowers a siderail of a hospital bed 28 of the patient room. An interaction sensor 16 illustratively detects the movement of the siderail and communicates an interaction signal to the badge 14 carried by the badged person. The badge 14 illustratively receives the interaction signal and an identification code of the interaction sensor 16, and transmits a signal to the remote computer 20 indicating the interaction sensor identification code, the badge identification code, and that the siderail movement has occurred. The remote computer 20 receives the signal from the badge 14 and records the siderail movement as $PSE_j$ in the memory device 22.

Figure 5F:
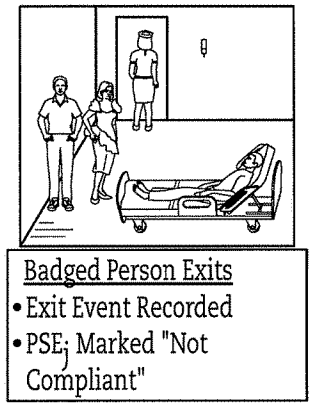

In FIG. 5F, the badged person exits the patient room without washing her hands within the predetermined amount of time from her exit. The occupant sensor 18 illustratively detects the exit event and communicates the exit event to the remote computer 20 for recording in the memory device 22. The remote computer 20 illustratively records the exit event. Illustratively, after the predetermined amount of time from $PSE_j$, the remote computer 20 marks the $PSE_j$ as "Not Compliant."

Figure 5G:
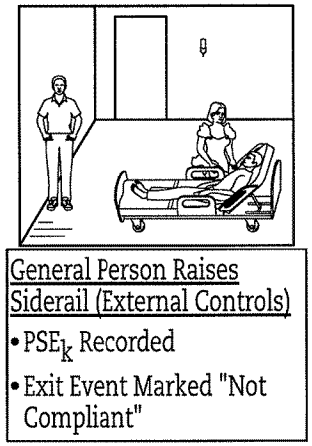

In FIG. 5G, one of the general occupants raises the siderail of the hospital bed 28 and does not wash her hands within the predetermine amount of time from raising the siderail. The interaction sensor 16 illustratively detects the movement of the siderail and communicates an interaction signal to the remote computer 20. The remote computer 20 receives the signal from the interaction sensor 16 and records the siderail movement as $PSE_k$ in the memory device 22. Illustratively, after the predetermined amount of time from the badged person's exit event, the remote computer 20 marks the exit event as "Not Compliant."

Figure 5H:
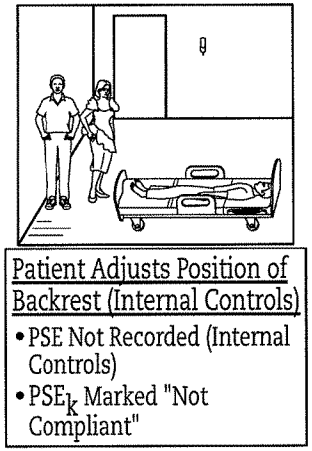

In FIG. 5H, the patient adjusts a position of the backrest of the hospital bed 28 using interior patient bed controls. The interaction sensor 16 illustratively detects the adjustment of the backrest position but does not communicate an interaction signal because the exterior bed controls were not used. Illustratively, after the predetermined amount of time from $PSE_k$ (e.g., the siderail movement event), the remote computer 20 marks the $PSE_k$ as "Not Compliant" since no handwash event occurred within the prescribed time. If the remote computer determines that any of the entry event, exit event, $PSE_j$, and/or $PSE_k$ being marked "Not Compliant" violates a hygiene threshold according to the hygiene operations scheme, the remote computer 20 transmits an indicator signal to the local indicator 26 to indicate non-compliance.

In some embodiments, multiple entry events, exit events, PSE's, and/or combinations thereof may be satisfied by one or more handwash events conducted within overlapping predetermined amounts of time, for example, if two different PSE's are recorded in close time and a single handwash event occurs within the predetermined amounts of time from each PSE, the remote computer 20 may mark both PSE's as "Compliant." In some embodiments, badge-person handwash events may only satisfy badged-person initiated PSE's, and general-person handwash events may only satisfy general occupant initiated PSE's.

In some embodiments, the hygiene operations scheme may be configured to be updated through a communication link (not shown) to support debugging, enhanced features, and or updated control design and may be configurable to turn on and off certain PSE triggering events and/or adjust the hygiene compliances rules via the remote computer 20. In some embodiments, the hygiene operations scheme may include qualitative factors for consideration in determining compliance rates, for example, a ranking of the hygienic risk associated with particular areas, healthcare devices, seasons, and/or other variables. The information regarding such variables is communicated to the remote computer 20 for storage and consideration in interpreting the hygiene operation scheme and determining the minimum compliance rates. In some embodiments, any of the minimum compliance rates may be determined by any number of statistical evaluations and/or adjustments based on historic, current, or predictive information and/or communications generated or received by the remote computer 20. A non-limiting example may include a weighted-matrix stored and maintained in the remote computer 20 that is updated based on historical hygiene data to apply weighted averages in determining the minimum compliance rates.

In some embodiments, the local indicator 26 may include a local display for showing text and/or images. The local indicator 26 may be configured to receive and display communications from a variety of hospital systems to provide visual communication of patient-specific information such as infection risk/isolation, allergies, and/or do not resuscitate instructions. The local indicator 26 may be configured to receive and display communications prescribing required assets such as lifts, stretchers, and/or wheelchairs, and may be implemented with asset tracking and/or detection sensor, for example on the bed 28, configured to trigger an audio and/or or visual alert if an occupant attempts to move a patient from the bed 28 without the proper asset in a proper location relative to the bed 28 to preempt and/or prevent improper lift attempts. An attempt to move a patient from the bed 28 may be inferred by the remote computer 20 based on the interaction sensor 16 detecting lowering of the siderail in combination with any other bed data information such as patient weight or movement of the patient on bed 28.

In some embodiments, the remote computer 20 receives information regarding hygiene observations from a third party. The remote computer 20 is illustratively configured to receive input from an authorized user that they have observed an action which requires subsequent handwashing. The authorized user may illustratively manually input on a hand held device any of the time, date, identifying information of the observed person, room number of the occurrence, type of occurrence (i.e., entrance/exit, other contamination), and whether a subsequent handwash was performed, and/or device used for handwashing.

The remote computer 20 is illustratively configured to incorporate the third party observation information into the determination of compliance rates. In some embodiments, the remote computer 20 may be configured to receive third party observation information from another device such as a tablet computer. Integration of third party observation information can assist in tracking, monitoring, revising, and trouble-shooting hygiene issues. Thus, system 10 receives some handwashing information automatically and receives other handwashing information via manual entry. For example, in a hospital, one wing may have the equipment installed for automatic monitoring of handwashing events (e.g., the equipment discussed herein in connection with FIG. 1) and another wing may have human monitors or observers that manually enter the handwashing events information. Remote computer 20 is able to merge the automatic and manual data sets according to this disclosure for determining handwashing compliance for a larger portion of the overall healthcare facility than for just the portion having the equipment needed for automatic handwashing monitoring.

In some embodiments, the third party information is provided to computer 20 as a comma-separated values (CSV) file. In one embodiment, the CSV file information is imported into a spreadsheet by computer 20 having the column headings event_time, staff_member, room, enter_leave, and adherent. In the event_time column, the date and time that an event occurred is stored. In the staff_member column, the name of the staff member that performed the entry or exit is stored. In the room column, the name (or number) of the room the staff member entered or exited is stored. In the enter_leave column, the words "enter" or "leave" are stored depending upon whether the staff member was entering or leaving the room. In the adherent column, a "1" is stored if the staff member washed their hands and a "0" is stored if otherwise.

Based on the foregoing, it will be appreciated that the present disclosure contemplates a software rules engine that can establish a need for an indicator or protocol, updating an indicator on a bed utilizing bed connectivity. The rules engine would continue to monitor the indicator or protocol, and would modify the displayed status indicator appropriately. For example, a hygiene compliance rules engine would require that a staff member utilize a dispenser within a defined time period, such as a number of seconds, upon entering a patient room. When a staff member enters a room, the locating solution would register staff presence, and initiate the protocol. If the system did not receive an indication of a wash event, the bed status indicator would change to provide staff feedback to utilize a hygiene station prior to interacting with the patient. Non-locating based events could also be associated with the rule engine to interact with locating information. For example, using bed data (patient weight and/or siderail position), along with asset tracking (lift presence), an indicator can be triggered on the bed that if the siderails are lowered and the patient is above a safe weight, an audible and/or visual indicator preempts the staff member form attempting to lift the patient without a proper lift in the proper location. This leverages the indicator on the bed and can replace alerts such as text messages and/or staff tag tones to provide indication to the staff member. These notifications can provide proactive notification prior to patient interactions and can prevent possible unsafe conditions such as improper lifts and/or hygiene.

The present disclosure may also include updated backend reporting to support technology and usability improvements; the ability to specify individual compliance goals and generate reports reflecting percentage adherence to specified goals; may display on interfaces quickly; ability to access current map and reports from a mobile device; simplified web view that display group scores; third-party observation data import of wash observation data including importing of csv file that contains wash information, and including that data in reports; ability to automatically push and/or retrieve assignment information such as staff assignments between different hospital systems such as a nurse call system and the remote computer 20; ability to email individual compliance scores to each individual under a pre-configured email to be automatically appended to the user name (i.e., userA as userA@hill-rom.com).

In illustrative embodiments, PSE's include detection by interaction sensor 16 that a position of a bed siderail has been changed. In some embodiments, PSE's may including triggering of bed functionality including but not limited to percussion/vibration/rotation therapies on/off; bed exit on/off; bed exit type; bed exit silence (i.e., suppresses bed exit); alarm silence (i.e., turns the beeping off); head of bed angle; bed position (i.e., bed low/chair mode etc.); head rail status; foot rail status; nurse call indicator button press; weigh patient; capture weight in system; bed brakes on/off; patient movement magnitude; patient movement direction; patient detected; CPR mode switch; bed cleaned switch. Additional PSE triggers can be added as needed and the system is configured to turn on and off any of the PSE triggers.

In some embodiments, communications, signals, transmissions, and indications may be carried out, partly or wholly, through one or more of wireless and wired connections and may include one or more intermediary devices between the source and the destination. Wireless connections may include any type of wireless protocol such as Wi-Fi (IEEE 802.11b/g/n), WiMax (IEEE 802.16e), Zigbee (e.g., 802.15.4), mobile communications technologies such as 3G or 4G technology, radio frequency (RF), and/or other wireless protocols. In some embodiments, proximity limitations may be enforced by configuration of the wireless connections to support only a limited range of communication, for example, by signal strength. Communications and communications signals may be communicated as secured and or encrypted in any known manner.

In illustrative embodiments, the handwash sensor 12, badge 14, interaction sensor 16, and occupant sensor 18 communicate directly with the remote computer 20. In some embodiments, one or more of the handwash sensor 12, badge 14, the interaction sensor 16, and occupant sensor 18 may communicate with the remote computer 20 through one or more intermediate communications devices, for example, the badge 14 may communicate received signals from any of the handwash sensor 12 and/or the interaction sensor 16 with the remote computer 20 through an intermediate device located within the patient room while the occupant sensor 18 communicates directly with the remote computer 20. In some embodiments, the handwash sensor 12 and/or the interaction sensor 16 may read the identification code of the badge 14 and may communicate both badged and non-badged operations of the handwash device and the identification codes of the respective sensor and the badge 14 to the remote computer 20, without transmission through the badge 14. In some embodiments, intermediary devices may receive one or more communication signals and may transmit any of one or more identical communication signals, combined communication signals, manipulated communication signals, duplicated communication signals and/or any combinations thereof. In some embodiments, intermediary devices may receive one or more types of communication signals and may transmit one or more different types of the communication signals, for example, if an intermediary device receives and transmits a signal both with wireless connections, the intermediary device may receive a signal as one type of wireless connection and transmit a signal of a different type of wireless connection.

In illustrative embodiments, the badge 14 is a single badge 14 that is Wi-Fi enabled for communication with the remote computer 20. In some embodiments, badge 14 may include one or more badges 14. Badges 14 may be assigned to each caregiver and other hospital personnel and may be used as a dedicated badge or as a badge for multiple systems. Badge identification codes are illustratively embodied as unique identifications code for each badge. In some embodiments, badge identification codes may be user (caregiver) specific and/or made indicate specific information about a user (caregiver), for example, badge identification codes may include indication of a caregiver's identity, assigned unit, assigned floor, and/or level of authority.

Sensors and other devices that explicitly and/or implicitly communicate, indicate, receive, and/or transmit any information, communications, indications, transmissions, and/or signals may include one or more receivers, transmitters, and/or combined receiver/transmitters as required to perform their functions.

According to this disclosure, the hygiene compliance system 10 receives information regarding caregiver-to-room and/or caregiver-to-patient assignments from another system within the healthcare facility. For example, some nurse call systems, such as the NaviCare® Nurse Call system available from Hill-Rom Company, Inc., have caregiver-to-room and/or caregiver-to-patient assignments or associations manually entered therein by a charge nurse or other staff member tasked with entering such information into the nurse call system. The nurse call system communicates, transfers, sends, or otherwise provides this information to system 10, according to this disclosure, so that the same caregiver-to-room and/or caregiver-to-patient associations do not have to be entered a second time. This increases caregiver efficiency by eliminating the need for redundant data entry in two different systems. Thus, this disclosure contemplates caregiver assignment integration between system 10 and one or more other systems within a network of a healthcare facility.

Although certain illustrative embodiments have been described in detail above, variations and modifications exist within the scope and spirit of this disclosure as described and as defined in the following claims.

The invention claimed is:

1. A hygiene compliance system, comprising: a handwash sensor configured to transmit a handwash signal indicative of handwash device operation, at least one badge configured to transmit a signal, an occupant sensor configured to detect a number of persons in a predetermined proximity and to transmit an occupant signal indicative of the number of persons, and a remote computer configured to communicate with the handwash sensor and the occupant sensor; wherein the remote computer determines a hygiene compliance rate based on the handwash signal and the occupant signal;

wherein the remote computer includes a processor and a memory device, the memory device being configured to store instructions that when executed by the processor determine the hygiene compliance rate based on the handwash signal and the occupant signal; and wherein the hygiene compliance rate is based on a badged-handwash compliance rate comprising a number of badged-person handwash events compared to a number of required badged-person handwash events, and an unadjusted compliance rate comprising a number of total handwash events compared to a number of required total handwash events.

2. The hygiene compliance system of claim 1, wherein the remote computer is configured to determine the number of required total handwash events based on the number of occupants detected by the occupant sensor.

3. The hygiene compliance system of claim 1, further comprising an interaction sensor, wherein the remote computer is configured to determine the number of required total handwash events based on an interaction signal from the interaction sensor indicative of interaction with a healthcare device.

4. The hygiene compliance system of claim 1, wherein the at least one badge, when within a predetermined proximity of the handwash sensor, receives a handwash sensor identification code and the handwash signal from the handwash sensor, and the at least one badge transmits a signal to the remote computer indicating the handwash sensor identification code, a badge identification code, and the handwash signal.

5. The hygiene compliance system of claim 1, wherein the handwash sensor is configured to receive a badge identification code from the at least one badge being within a predetermined proximity of the handwash sensor, and to transmit a signal to the remote computer indicating a handwash sensor identification code, the badge identification code, and the handwash signal.

6. The hygiene compliance system of claim 1, wherein the remote computer is configured to determine whether the hygiene compliance rate violates a threshold dictated by a hygiene operations scheme.

7. The hygiene compliance system of claim 6, wherein the remote computer is configured to transmit an indicator signal indicating that the hygiene compliance rate violates the threshold to a local indicator to activate the local indicator to indicate non-compliance with the hygiene operation scheme.

8. The hygiene compliance system of claim 1, wherein the predetermined proximity is a patient room of a hospital.

9. A hygiene compliance system, comprising: a handwash sensor configured to transmit a handwash signal indicative of handwash device operation, at least one badge configured to transmit a signal, an occupant sensor configured to detect a number of persons in a predetermined proximity and to transmit an occupant signal indicative of the number of persons, and a remote computer configured to communicate with the handwash sensor and the occupant sensor; wherein the remote computer determines a hygiene compliance rate based on the handwash signal and the occupant signal;

further comprising an interaction sensor configured to transmit an interaction signal indicative of interaction with the healthcare device;

wherein the healthcare device is a hospital bed and the interaction sensor is configured to detect interaction with the hospital bed and to transmit the interaction signal indicative of interaction with the hospital bed; and wherein the interaction sensor is configured to detect a movement of a siderail of the hospital bed and to transmit the interaction signal indicative of siderail movement.

10. The hygiene compliance system of claim 9, wherein the interaction sensor is configured to transmit the interaction signal only if an exterior bed control is used to achieve the movement the siderail.

11. A hygiene compliance system, comprising: a handwash sensor configured to transmit a handwash signal indicative of handwash device operation, at least one badge configured to transmit a signal, an occupant sensor configured to detect a number of persons in a predetermined proximity and to transmit an occupant signal indicative of the number of persons, and a remote computer configured to communicate with the handwash sensor and the occupant sensor; wherein the remote computer determines a hygiene compliance rate based on the handwash signal and the occupant signal;

further comprising an interaction sensor configured to transmit an interaction signal indicative of interaction with the healthcare device;

wherein the healthcare device is a hospital bed and the interaction sensor is configured to detect interaction with the hospital bed and to transmit the interaction signal indicative of interaction with the hospital bed; and wherein the interaction sensor is configured to detect an adjustment of a position of a backrest of the hospital bed.

12. The hygiene compliance system of claim 11, wherein the interaction sensor is configured to transmit the interaction signal only if an exterior bed control is used to achieve the adjustment of the position of the backrest of the hospital bed.

13. A hygiene compliance system, comprising: a handwash sensor configured to detect handwash device operation, at least one badge configured for signal transmission, an occupant sensor configured to detect a number of persons in a predetermined proximity, an interaction sensor configured to detect interaction with patient surroundings, and a remote computer configured to communicate with the handwash sensor, the occupant sensor, and the interaction sensor; wherein the remote computer determines a hygiene compliance rate based on the communications with the handwash sensor, the occupant sensor, and the interaction sensor;

wherein the predetermined proximity is a patient room of a hospital; and wherein the patient surroundings include a hospital bed and the interaction with patient surroundings includes adjustment of the position of the backrest of the hospital bed, and the interaction sensor is configured to communicate an interaction signal indicating the adjustment of the position of the backrest to the remote computer, and the remote computer determines the hygiene compliance rate based on the interaction signal.

14. A hygiene compliance system, comprising: a handwash sensor configured to transmit a handwash signal indicative of handwash device operation, at least one badge configured to transmit a signal, an occupant sensor configured to detect a number of persons in a predetermined proximity and to transmit an occupant signal indicative of the number of persons, and a remote computer configured to communicate with the handwash sensor and the occupant sensor; wherein the remote computer determines a hygiene compliance rate based on the handwash signal, the occupant signal, and wash observation data from a third party observation information;

wherein the remote computer includes a processor and a memory device, the memory device being configured to store instructions that when executed by the processor determine the hygiene compliance rate based on the handwash signal and the occupant signal; and wherein the hygiene compliance rate is based on a badged-handwash compliance rate comprising a number of badged-person handwash events compared to a number of required badged-person handwash events, and an unadjusted compliance rate comprising a number of total handwash events compared to a number of required total handwash events.

15. The hygiene compliance system of claim 14, wherein the remote computer is configured to generate reports including a hygiene compliance rate associated with an individual caregiver and to automatically transmit a daily electronic message to the individual caregiver indicating the hygiene compliance rate associated with the individual caregiver.

16. The hygiene compliance system of claim 14, wherein the remote computer is configured to automatically retrieve staff assignments from other hospital systems.

* * * * *